US006793044B2

(12) United States Patent
Koehler et al.

(10) Patent No.: US 6,793,044 B2
(45) Date of Patent: Sep. 21, 2004

(54) TRAVEL SEQUENCE PLANNING FOR ELEVATORS

(75) Inventors: Jana Koehler, Lucerne (CH); Kilian Schuster, Ballwil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/261,342

(22) Filed: Sep. 30, 2002

(65) Prior Publication Data

US 2003/0085079 A1 May 8, 2003

Related U.S. Application Data

(63) Continuation of application No. PCT/CH01/00205, filed on Mar. 29, 2001.

(30) Foreign Application Priority Data

Mar. 29, 2000 (EP) ..... 00106767
Mar. 29, 2000 (EP) ..... 00106768

(51) Int. Cl.[7] ..... B66B 1/18

(52) U.S. Cl. ..... 187/382; 187/247

(58) Field of Search ..... 187/247, 381, 187/380, 382, 324, 387, 392, 385, 386

(56) References Cited

U.S. PATENT DOCUMENTS 5,233,138 A * 8/1993 Amano ..... 187/382
5,239,141 A * 8/1993 Tobita et al. ..... 187/382
5,283,399 A * 2/1994 Fujino et al. ..... 187/382
5,767,461 A * 6/1998 Nakagawa et al. ..... 187/380
5,936,211 A * 8/1999 Kim ..... 187/382
6,237,721 B1 * 5/2001 Siikonen ..... 187/382
6,315,082 B2 * 11/2001 Hikita ..... 187/382
6,394,232 B1 * 5/2002 Iwata et al. ..... 187/382

FOREIGN PATENT DOCUMENTS

JP 02052875 * 2/1990

* cited by examiner

*Primary Examiner*—Jonathan Salata
(74) *Attorney, Agent, or Firm*—MacMillan, Sobanski & Todd, LLC

(57) ABSTRACT

A method and an apparatus for determining the optimal travel sequence for an elevator installation includes smart terminals sending destination specific travel requests and other planning information to a job manager for each elevator car. The job managers perform a situation-based search process to determine the optimal travel sequence plan for the associated elevator and submit an offer to the terminal sending the travel request. The terminal compares offers and books a selected one. The job managers are responsive to relevant changes in the situation upon which the plan is based for determining a changed actual travel sequence and associated changed offer.

15 Claims, 7 Drawing Sheets

```
( : objects
(p1                          - passenger )
(p2                          - passenger )
(f1,f2,f3,f4,f5,f6,f7        - floor ))
```

15

```
(upper f1 f2) (upper f1 f3) (upper f1 f4)
(upper f1 f5) (upper f1 f6) (upper f1 f7)
(upper f2 f3) (upper f2 f4) (upper f2 f5)
(upper f2 f6) (upper f2 f7) (upper f3 f4)
(upper f3 f5) (upper f3 f6) (upper f3 f7)
(upper f4 f5) (upper f4 f6) (upper f4 f7)
(upper f5 f6) (upper f5 f7) (upper f6 f7)
```

16

```
( : init (origin p1 f2)
(origin p2 f1)
(destin p1 f7)
(destin p2 f5)
(boarded p2)
```

17

```
(lift-at f4))
```

18

14

```
(:goal (forall (?p - passenger) (served ?p))
```

Fig. 7

```
( : objects
(p1                                  - passenger )
(p2                                  - vip )
(f1,f2,f3,f4,f5,f6,f7                - floor ))
```

33

```
( : init (origin p1 f1)
(origin p2 f3)
(destin p1 f7)
(destin p2 f7)
(boarded p1)

(no-access p1 f3)
(no-access p1 f4)
```

34

```
(lift-at f2))
```

35

```
(:goal (forall (?p - passenger) (served ?p))
```

36

32

Fig. 8

```
( : objects
(p2                                  - vip )
(f1,f2,f3,f4,f5,f6,f7                - floor ))
```

43

```
( : init
(origin p2 f3)
(destin p1 f7)
```

44

```
(lift-at f2))
```

45

42

```
(:goal (forall (?p - passenger) (served ?p))
```

46

Fig. 9a

37

33

```
(define (domain miconic)
(:requirements :adl)
(:types passenger - object
going_up going_down vip going_direct attendant never_alone
conflict_A conflict_B - passenger floor - object)

(:predicates
(origin ?person - passenger ?floor - floor)      ; boarding point of ?person is ?floor
(destination ?person - passenger ?floor - floor) ; alighting point of ?person is ?floor
(no-access ?person - passenger ?floor - floor)   ; access restriction
(boarded ?person - passenger)                    ; whether ?person has boarded or not
(served ?person - passenger)                     ; ?person was conveyed
(lift-at ?floor - floor)                         ; actual position of the cage is ?floor
)
```

38

Fig. 9b

39

```
(:action stop
 :parameters (?f - floor)
 :precondition (and (lift-at ?f)
 (imply (exists (?p - conflict_A)
 (or (and (not (served ?p)) (origin ?p ?f)) (and (boarded ?p) (not
 (destination ?p ?f)))))
 (forall (?q - conflict_B) (and (not (boarded ?q) (or (served ?q)
 (not (origin ?q ?f))))))
 (imply (exists (?p - conflict_B)
 (or (and (not (served ?p)) (origin ?p ?f)) (and (boarded ?p) (not
 (destination ?p ?f)))))
 (forall (?q - conflict_A) (and (not (boarded ?q)) (or (served ?q)
 (not (origin ?q ?f))))))
 (imply (exists (?p - never_alone) (or (and (origin ?p ?f)
 (not (served ?p)))
 (and (boarded ?p) (not (destination ?p ?f)))))
 (exists (?q - attendant) (or (and boarded ?q) (not (destination ?q ?f))
 (and (not (served ?q)) origin ?q ?f)))))
 (forall (?p - going_direct) (imply (boarded ?p) (destination ?p ?f)))
 (or (forall (?p - vip) (served ?p)) (exists (?p - vip) (or (origin ?p ?f)
 (destination ?p ?f))))
 (forall (?p - passenger) (imply (no-access ?p ?f) (not (boarded ?p)))))
 ;effect (and (forall (?p - passenger) (when (and (boarded ?p)
 (destination ?p ?f))
 (and (not (boarded ?p)) (served ?p))))
 (forall (?p - passenger) (when (and (origin ?p ?f) (not (served ?p)))
 (boarded ?p)))))
```

TRAVEL SEQUENCE PLANNING FOR ELEVATORS

CROSS-REFERENCE TO RELATED APPLICATION

This application is a continuation of the co-pending Patent Cooperation Treaty international patent application no. PCT/CH01/00205 filed Mar. 29, 2001.

BACKGROUND OF THE INVENTION

The present invention relates to a targeted or destination call control for lifts or elevators according to the definitions of the patent claims.

In known manner an elevator control serves the purpose of serving car calls to the various floors of the building. The drive of the elevator knows as commands merely the instructions "travel upwardly", "travel downwardly", "door open" and "door close".

In larger buildings usually a group of two to eight elevators is installed, from which it is now necessary to select that elevator which appears the most suitable for a newly input car call from a floor, a so-termed floor or hall call. As a rule this is the elevator which has the shortest travel path to this floor. If, however, each elevator of the group has to serve, on this travel path, other hall calls beforehand, then passengers will board at the floors, the destination of whom is known only when they have pressed the corresponding car buttons. The allocation of a hall call to an elevator thus becomes problematic, since permanent uncertainty about the destinations to be traveled to exists.

Accordingly, in the elevator industry numerous experiments can be observed to skillfully "guess" the possible destination floors of the passengers by means of use of learning methods on the basis of neuronal networks or genetic algorithms. The effect of such a method is, however, very limited, because merely coarse traffic patterns, such as, for example, the morning upward peak, are identifiable with any certainty. However, it remains unclear what a passenger wants when, for example, he or she calls a elevator on a Monday morning about 10:37 o'clock at the 10th floor of a high-rise office.

Another starting point for the solution of the control problem consists of so-called destination call controls. With a destination call control the passengers, before boarding an elevator or an elevator car, input their desired destination floor, for example by way of a keyboard similar to a telephone, i.e. a so-termed terminal. The boarding floor is known to the destination call control from the position of the terminal. After input of the destination floor, an allocation algorithm of the control ascertains that elevator of the elevator group which enables the quickest and most comfortable transport for the passenger to his or her destination. The terminal indicates to the passenger this elevator of the group of elevators and the passenger can step into the correspondingly marked elevator at his or her own pace. If the elevator stops for boarding, then the destination of the passenger is confirmed, for example, by way of a display device in the door frame. In the car itself, there are no longer present any buttons for the input of destinations. In this manner, through use of a destination call control, passengers with an identical transport destination can be grouped and thereby the transport performance of the elevator system increased.

An example, which is known from the European patent document EP 0 699 617 A1, of such a destination call control is, in addition, in the position of identifying individual passengers. For each identified passenger additional data with respect to boarding position and disembarking position, the passenger space requirement and possible additional service requirements are taken into consideration, by access to a data memory, in the determination of the optimal transport possibility.

This and other conventional destination call controls are based on an intuitive approximation algorithm on the basis of allocation rules. This allocation algorithm is designed and programmed in each instance specifically to requirement. In the case of a travel request, i.e. the destination call, the data related to persons and the installation and detected by way of an appropriate sensor system are passed on to the allocation algorithm and run through the algorithm for determination of the travel sequence.

If new additional travel requests arise during execution of a travel sequence, then the already computed travel sequence is modified to that effect. In that case, however, only simple modifications can be undertaken, which can have the consequence that only a modified travel sequence which is related to a destination call and which is no longer the optimal travel sequence with respect to the changed preconditions is executed. Long waiting times and/or transport times for the passengers can result therefrom. Moreover, interrelationships of individual control options, so-termed service requirements, are not always expressed logically and in unbroken manner in such a fixedly programmed allocation algorithm. Moreover the control software created in requirement-specific form for computation of the travel sequence is regarded as detailed and complicated. It is disadvantageous, in particular, that a once-created allocation algorithm can be subsequently adapted to different customer-specific control requirements only with substantial cost. In practice, for adaptation to changed service requirements a new elevator specific allocation algorithm has to be prepared in each case and implemented in entirety.

SUMMARY OF THE INVENTION

The targeted call control for elevator installations according to the present invention concerns an apparatus, which apart from an increase in transport performance is also constructed to be flexible and robust and takes into consideration, in particular, individual and/or collective transport needs of passengers.

For the fulfillment of this object the invention is given by a method for travel sequence planning which is characterized in particular by the fact that a situation-based search process for determining the optimal travel sequence is provided. A solution in terms of device is given by a targeted call control that proposes an organization of the traffic volume with use of a so-termed planning system.

According to the invention there is thus provided in place of a previously employed, use specific fixedly programmed control algorithm, a planning system which is known per se. The planning system operates according to a situation-based search process and determines, related to destination call and proceeding from the instantaneous operational state of the elevator installation and the objective state to be produced of the elevator installation, the situation-specific optimal travel sequence.

The use in accordance with the invention of a situation-based search process essentially offers the advantage that in the case of any relevant change in the instantaneous situation, for example on registration of a new travel request, disruptions in the execution of a travel sequence, or the like, a completely new actual travel sequence is determined—in the extreme case after each executed travel sequence step—and the elevator drive then executes this new sequence.

With each registration of a relevant change, for example, in the case of each destination call, the instantaneous operational state and the desired objective operational state of the elevator installation are declaratively combined on the basis of facts in a state description. This state change, which is illustrated in the state description and which is to be achieved, of the elevator installation is passed on to the planning system in translated form as a part of a situation representation, which is described further below. The situation-based search process thus has, with each registered destination call, complete information with respect to the traffic state of the elevator installation. It can accordingly compute the optimal serving of the destination call for a fixed, predefined optimization criterion. This computation process is so designed that in fact the optimum can be found on the basis of the given criterion under real-time requirements.

The determined travel sequence plan is constructed by the planning system in such a manner that the desired state change can be achieved in execution of the travel sequence plan.

An elevator installation with travel sequence planning in accordance with the present invention consequently executes in each instance exclusively the travel sequence representing the optimum for the actual planning situation. The optimization can in that case be carried out on the basis of entirely different criteria, wherein the objectives of optimization result from an increase in the performance of the elevator, a reduction in waiting times and/or serving times and travel times of the passengers or, however, an improvement in a balanced travel management and the like.

The planning process is in advantageous manner limited in time, in that computing performance and memory needs are limited. The search process finds the optimal or approximately optimal travel sequence within these restricted computing resources. So termed "anytime" algorithms for that purpose are known to the expert and can be used for such a search process.

According to an advantageous embodiment of the search process according to the present invention, the state description is passed on in translated form to the planning system preferably together with an operator description in the situation representation.

The operator description is communicated to the destination call control according to the invention at the time of configuration, preferably on installation of the system with the customer. It contains operators which specify elemental state transitions of the elevator installation. The operators form, as elemental modules for the travel sequence solution to be constructed, the basis of the travel sequence plan to be determined. In the case of each destination call allocation or in the case of solution of a concrete planning task, the planning system selects the operators, which are to be used in the solution, from the operator description and determines concrete values for operator parameters as well as an arrangement sequence in which operators occur in the travel sequence plan. This arrangement sequence specifies the execution sequence of the operators in the plan, thus the travel sequence.

By contrast to previous fixedly programmed allocation algorithms the planning system can be provided with any number of operators, including such which can serve service requirements not yet present on the side of the customer at the moment of installation. If these requirements arise at a later time, then it is merely necessary to communicate to the planning system a corresponding situation representation in which these service requirements are formulated. The system can then immediately solve such tasks. If service requirements arise for which no operators are provided, then the modularity of the operators in a planning system ensures that new operators can be added in or taken out in simple manner without the already present operators having to be influenced. Elevator installations can thus be adapted very simply and flexibly to changing customer needs with respect to traffic organization by changing the number of operators available for control and also by the definition of the operators themselves.

In the case of control of a group of elevators by the destination call control according to the invention, consideration of the service requirements in continuous operation of the elevator installation takes place without a separate reservation of a elevator of the elevator group having to be carried out for the passenger requiring the respective service. The elevator control and the operators are matched to one another in such a manner that, in principle, any elevator can at any time execute all special service requirements predetermined by way of the situation representation. If needed, the service requirement is quasi call-specifically integrated in the group operation.

The embedding of a planning system as a core of the destination call control is possible in a centralized concept, a decentralized concept or a combination of the central and decentralized concept.

In the case of a construction of the destination call control with a so-termed central job manager this is a decision interface between the terminals and the individual job managers of the elevators. The terminals direct their transport inquiries to the central job manager. The job manager asks each of the job managers of the individual elevators for a transport offer for the respectively registered destination call, i.e. the so-termed job. It is incumbent on the central job manager alone to manage all actual transport inquiries of passengers, i.e. the destination calls, and the booking of the transport requests, i.e., so-termed jobs, to the respectively selected elevator. The terminals receive from the central job manager as a response the identification of the selected elevator, which they thereupon display (for example "A" or "B").

The communication between the terminals and the elevators is simple to organize, because all communication runs by way of a central control, i.e. the central job manager. The organization of the jobs takes place at a central job manager in a waiting queue, a so-termed "first in, first out" data structure. This organization is simple and secures a clear running sequence.

In the case of the central concept the terminals only have to process the destination call input of the passenger as well as the indication of the elevator booked by the central job manager and require for this purpose only simple software. The use of simple and economic terminals makes this possible.

In the case of a decentralized construction of the job manager, the terminals are connected by way of a capable communications network with the job managers of the individual elevators of an elevator group. The terminals directly ask the job managers of the individual elevators for a transport offer for the respectively registered destination call. The terminals independently collect these offers, compare them and determine the optimal booking of the passenger. In the case of a decentralized job manager the organization of the jobs takes place in parallel for several jobs, wherein a desired superimposition of inquiries and bookings is possible.

Further advantages of the decentralized concept of the destination call control reside in the—by comparison with the centralized concept—faster reaction of the job manager to inquiries, an increased stability of the overall system due to the decentralization and a simplified architecture of the job manager, since a separate central control does not have to be provided.

Insofar as the decentralized embodiment is provided, the terminals are equipped with intelligent booking software. The communication between the terminals and the job managers of the individual elevators is preferably carried out by way of use of contract network protocols. The job managers of the individual elevators are themselves in a position to organize jobs in parallel and to correctly manage their status.

The centralized and decentralized concepts of the job manager can also be combined-with one another in a destination call control. Any number of job managers, which control one or more elevators, can be present in a network.

According to a particularly preferred development of the invention the situation-based destination call control is represented as a multi-agent system, which realizes the entire controls of installation, wherein the planning system is an agent in this multi-agent system. The elevator installation can comprise any number of elevators with any layout. Thus, several elevators can also cooperate with a different number of decks in one group, i.e. a so-termed heterogeneous multi-decker group.

The construction as a multi-agent system enables a modular implementation of the destination call control, in which individual components, i.e. the so-termed agents, for example planning system, doors, drive and taxi driver, can be exchanged as desired without the entire system having to be changed.

An event-controlled activation of the agents in a multi-agent system makes the system substantially more robust relative to occurring errors. If, for example, a shaft door at a story breaks down due to a faulty contact, then either the job manager can cause an evacuation travel or, however, the taxi driver can initially allow the still-present plan to be executed. For further passenger inquiries, the fault can be communicated to the configuration manager which informs all relevant components of the system that temporarily this floor cannot be served by this elevator. A failure of components does not signify immediate failure of the entire system as long as the safety of the passengers is guaranteed.

Further advantageous refinements of the invention are contained in the independent claims.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 7 shows an instantaneous state description of the elevator "A" in the targeted call control shown in FIG. 5;

FIG. 8 shows an instantaneous state description of the elevator "B" of the targeted call control shown in FIG. 5; and FIGS. 9(*a*), 9(*b*) shows the construction of an operator with a stop instruction, as used in the targeted call control shown in FIG. 5.

DESCRIPTION OF THE PREFERRED EMBODIMENT

Figure 1:
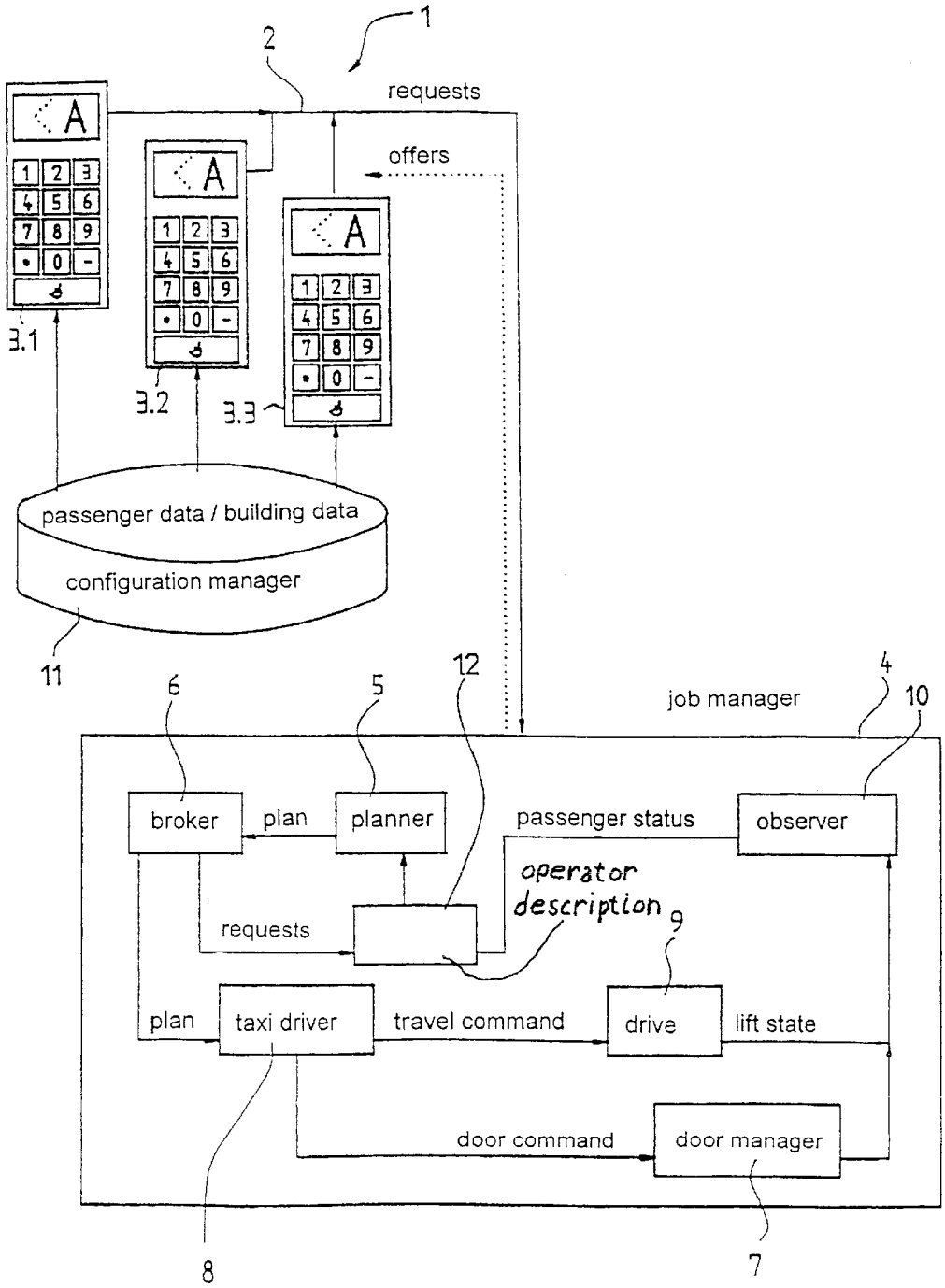
FIG. 1 is a block diagram of the construction of a first embodiment of the targeted call control, according to the present invention, with a decentralized job manager for the control of an individual elevator.

FIG. 1 shows schematically a block diagram of the construction of a destination or targeted call control 1 according to the present invention with a situation-induced travel sequence planning of the traffic volume of an individual elevator. The targeted call control 1 is constructed as a multi-agent system. The basis of the multi-agent system is a capable communications network 2, by way of which three devices, which are distributed in the building, for destination call (travel request) input, so-termed terminals 3.1, 3.2, 3.3, are connected with a decentralized job manager 4.

In an ideal manner, an architecture for spontaneous networking is selected as the communications network 2. In this embodiment an ad-hoc network, which is known per se with the designation IRON is provided. IRON assists spontaneous networking and is thus a decisive precondition for a configuration-free control.

Known examples for architectures for spontaneous networking are "Jini", "Universal Plug and Play" and "Bluetooth". In such a communications network 2 apparatus capable of networking, so-termed agents, log-on and interact without need for a configuration or an administration. The integration of all these apparatus and the services implemented thereat run fully automatically. The most important methods of such a communications network 2 are "register", "lookup" and "notify".

Through "register", each individual apparatus performs a log-on in the network and make its services known. Through "lookup", one apparatus can find another apparatus or a required service. Through "notify", one apparatus can log-on at another apparatus for information about the entry of specific events.

In an elevator group, terminals, drives, car doors, central job managers and/or decentralized job managers can log-on as an apparatus capable of networking. Terminals log-on in the network with their floor position and x, y-coordinates in the network and inform themselves about all job managers present. Drives represent the physical components of the elevator control. They make information available about which floor they can travel to, how many shaft doors are located at a floor and at which side these are positioned. In addition, information can be subscribed to at the drive with regard to specific events such as change of the selector and change of the state (for example, traveling, arriving, stationary). Car doors log-on with information about the drive to which they belong, the deck at which they are disposed and the side at which they open. By way of this information the job manager immediately finds out how many decks an elevator has and how many doors per deck are present. Job managers log-on in the network with information about which drives they represent; a single drive in the strictly decentralized concept or all those present in the strictly centralized concept.

In principle any number of components can log-on in the network. The traditional group concept of elevators is thus superfluous and, in particular, any number of elevators with quite different layouts can be present in one group. If, for example, eleven drives log-on, of which three have only one door, four each have three doors on two decks and four each have six doors uniformly distributed on three decks, then there is present an example of a so-termed heterogeneous multi-decker group consisting of:

three single-deckers with only one door;

four double-deckers, wherein one deck is equipped with one door and the other decks with two doors; and four triple-deckers, in which each deck has two doors.

The job manager of each individual elevator is in a position of recognizing, and correctly processing in the control, the number of decks and doors of its associated drive.

This comprises in particular:

The planning system plans, in the case of a multi-decker, the boarding and alighting of the passengers by way of all decks which are present.

The taxi driver of the job manager transmits at a stop the door opening commands to all doors which open at floors at which passengers wish to board or alight.

In the case of the IRON communications network 2 used here, agents can mutually inform about changes and prepare and integrate data in the own operating logic. An agent can find out, via broadcast, which other agents have logged-on in the network and transmit communications to other agents. Moreover, an agent can subscribe to data at another agent.

The individual components of this multi-agent system—the so-termed agents—are, apart from the above-mentioned terminals 3.x, included in the job manager 4 which integrates all components necessary for the logical and physical control of a elevator. These components are a planning system or planner 5, a broker 6, a door manager 7, a taxi driver 8, the drive 9 of the elevator and an observer 10.

The terminals 3.1, 3.2, 3.3 are equipped with intelligent booking software and directly ask each job manager 4 for a transport offer for the respectively registered travel request (destination call). The communication between terminals 3.x and job managers 4 is carried out by means of contract network protocols. Each of the terminals 3.1, 3.2, 3.3 is equipped with a device for identification of passengers, to which a configuration manager 11 belongs.

The actual building layout, such as, for example, the number of floors, access zones, division of the passengers into passenger groups, access authorizations, service requirements, etc., and passenger data are stored in the configuration manager 11 to be capable of calling up. On registration of a destination call, each terminal 3.x can call up passenger data from the configuration manager 11 and pass the data on to the broker 6. Thus, each terminal can, for example, check whether the registered passenger has access permission for the desired destination floor. If the check is successful, then the terminal 3.x asks the job manager 4 of the elevator for its transport offer.

The planner 5 itself plans the optimal serving of the new passenger with consideration of the actual, elevator-specific traffic situation and in that case produces an optimal plan which is then passed on to the broker 6, which is described further below, for control of the drive 9 of the elevator. The starting point for the planner 5 is a situation representation which is actual at each point in time at which the broker 6 records new passengers, whereas the observer removes conveyed passengers.

The broker 6 communicates with the three terminals 3.1, 3.2, 3.3 by way of a two-stage contract network protocol. It receives the inputs of the terminals 3.1, 3.2, 3.3, records them in the situation representation of the planner 5, checks the generated optimal plan with respect to the effect of the newly included passenger on the transport of the already booked passengers and communicates the transport offer to the terminal. If no plan could be found because, for example, the problem cannot be solved due to insoluble conflicts between the passenger groups for this elevator, then the broker 6 also informs the corresponding terminal 3.x about that fact. If the passenger is booked then the broker 6 sends to the taxi driver 8 the actual travel sequence plan. The terminal 3.x now carries out the indication on the display.

The observer 10 monitors the state of the elevator installation and updates the situation representation for the planner 5. If it thus establishes that the elevator has stopped at a floor and the doors were correctly opened, then all passengers are flagged as -served- for whom -boarded- applies and the destination of whom corresponds with the floor. Passengers still waiting there are flagged as -boarded-, since they board when the elevator has arrived at them. The observer 10 in that case has no knowledge of the plan or the activities of the taxi driver 8, but is supported solely on the information to which it has subscribed at the drive 9 and at the door manager 7. This is a precondition also for the occurrence of a special operation such as, for example, triggering of the control in the case of fire, which control takes over controlling by way of the drive 9 and interrupts the taxi driver normal operation in order to ensure that the situation representation is correctly updated in correspondence with the actually occurring changes in state.

The taxi driver 8 goes over its respective actual plan, i.e. it transmits the corresponding commands to the drive 9 of the elevator and the drives of the doors. It knows from its actual plan where the elevator is to next stop in accordance with schedule and how long the doors have to be open so that all passengers have sufficient time for boarding and alighting. How many passengers change state at a stop was already determined by the planner 5 if the taxi driver 8 no longer has a plan, then it releases the elevator so that this can be parked. In any situation the taxi driver 8 can exchange its actual travel plan for the actual plan sent thereto by the broker 6. How this change takes place depends on in which implementation state the taxi driver is disposed. Thus, for example, it is necessary that a stop process, once begun, of the old plan must firstly be concluded before the taxi driver 8 can travel to the first stop of the new plan.

The drive 9 executes the travel and stop commands which it obtains from the taxi driver 8 and, in addition, it learns the travel times of the elevator between the individual floors. It makes the travel timetable available to the planner 5 for the optimization and also reports where the elevator is actually disposed and in which direction it travels or whether it has just stopped.

The door manager 7 manages all doors of the elevator and monitors whether the doors correctly open and close. In that case, doors can be present on different sides of the car. It also determines the door opening and closing times of the doors and communicates them to the planner 5 for optimization of the serving times of the passengers.

Each of the components of the call control 1 is implemented as an independent agent that executes independent actions in the case of occurrence of specific events. In particular, the most diverse events can thereby be superimposed. Thus, for example, the broker 6 can simultaneously receive the inquiries of different terminals 3.1, 3.2, 3.3 and submit them to the planner 5. The decentralized job manager 4 can make parallel delivery of an offer for several jobs whilst the booking of other jobs is still outstanding. The jobs are obligatory only when the corresponding terminal 3.x books.

Since between the delivery of the offer by the broker 6 and the booking by the respective terminal 3.x a time period of any length can in theory pass, it is possible that in the interim another terminal has already placed a booking. In this situation the broker 6 must check whether the delivered offer is still valid when the terminal now sends its booking. This random superimposition of inquiries and bookings makes it necessary for the terminal to wait for an acknowledgement of its booking and, in the case of absence of an acknowledgement, to seek an alternative booking at another job manager 4. If the replanning is also unsuccessful because the situation in the elevator has, for example, changed in such a manner that irresolvable conflicts between the already booked passenger and the new passenger to be booked now arise, then the terminal 3.x receives a corresponding feedback.

Figure 2:
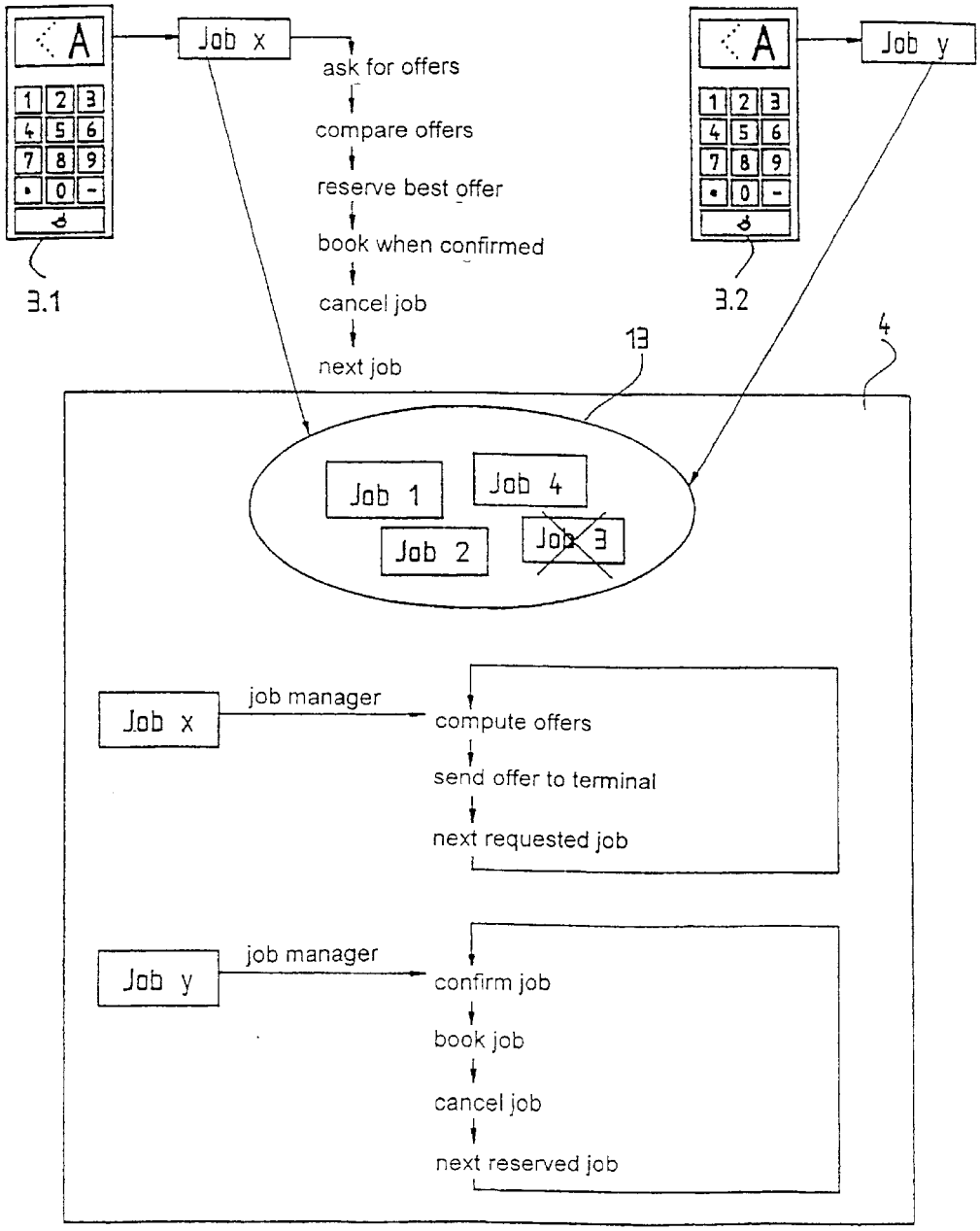
FIG. 2 shows a schematic illustration of the organization of a pool of requested and offered jobs in the targeted call control shown in FIG. 1.

FIG. 2 shows a pool 13 of requested and offered jobs Job 1 to Job 4 at the decentralized job manager 4. Each terminal 3.1, 3.2 usually has only one concrete job Job x or Job y which it wishes to book at an elevator. It accordingly sends this job to all of the job managers 4, which are known to it, of the group of elevators of which it knows from the drive data whether the associated elevator can serve not only the boarding floor but also the alighting floor, of the passenger. Unnecessary requests to elevators which do not, in principle, come into question for the transport, are thus avoided.

Two kinds of jobs are present at the decentralized job manager 4: these are, on the one hand, jobs, i.e. the Jobs x, which were requested and for which the job manager 4 has to compute an offer, and on the other hand Jobs y for which the job manager 4 has already delivered an offer, but does not yet know whether the terminal is actually booked with it.

In the case of the first embodiment illustrated here and shown in FIG. 1 only a single elevator is present. The elevator can, however, also be part of an elevator group. The invention is usable, without restriction, for such elevator groups. In the case of an elevator group, also, the terminals 3.1, 3.2, 3.3 directly ask the job managers 4 of the individual elevators for a transport offer. The terminals 3.1, 3.2, 3.3 independently collect these offers, compare them and compute the optimal booking of the passenger. Each elevator subject of an inquiry computes independently of the others and with consideration of the actual elevator-specific traffic situation its optimal travel sequence plan for serving the new passenger. The offer of each elevator subject of an enquiry is sent back to the terminal, which selects the best offer and commissions the corresponding elevator with the transport of the passenger. If the job manager 4 confirms the booking relative to the terminal from which the transport offer had been requested, then the booking is obligatory and is indicated to the passenger at the terminal. If a job manager no longer reports, then the terminal also reacts thereto and does not wait endlessly for the lacking offer.

The mode of operation of the targeted call control according to the invention as described so far is, according to FIG. 1, described in the following by way of the example of a planning problem of a elevator installation with only a single elevator with a single-door car, which services a building (not illustrated here) with stopping points at seven floors f1 to f7. The elevator car stands, at the moment, at the floor f4. A passenger P1 waits at a floor f2 and wants to go to a floor f7 and a further passenger P2 is already in the car and wants to go from floor f1 to floor f5. The travel sequence of the car is to be organized in accordance with the invention by means of the planning system 5.

The characteristics of the elevator, i.e. the instantaneous operational state of the elevator, are detected and actualized in the situation representation by the observer 10. The characteristics of the passengers P1, P2 and particularly the destination calls of the passengers P1, P2 are passed on by way of terminals 3.1, 3.2, 3.3, in conjunction with the configuration manager 11, as input magnitudes of the destination call control 1 to the broker 6, which records them in the situation representation of the planner 5, as shown in FIG. 2.

Figures 3, 4:
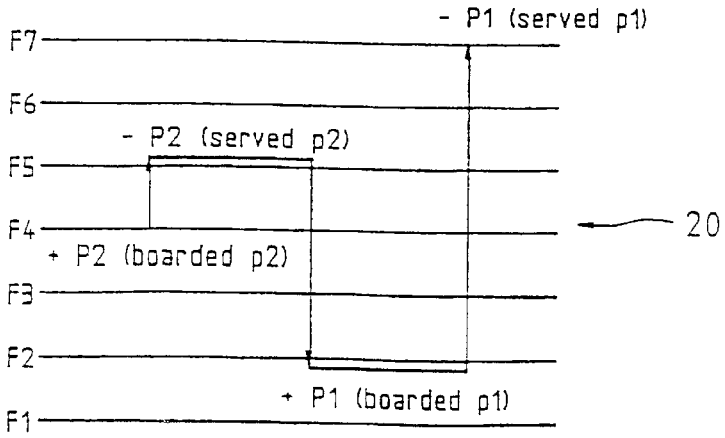
FIG. 3 shows an instantaneous state description according to the targeted call control shown in FIG. 1.
FIG. 4 shows a graphical illustration of the determined travel sequence plan according to the targeted call control shown in FIG. 1.

Thus, in each planning process, which is started, for example, by registration of a travel request (destination call), the determined operational state and the desired objective state, thus the change in state of the elevator to be achieved, are declaratively combined in a situation or state description 14, comprehensible for the planning system 5, which is illustrated in FIG. 3.

The situation or state description 14 depicted in FIG. 3 is expressed in the plan representational language PDDL according to McDermott et al., 1998. There are known to the expert also other modeling languages which differ with respect to their expressive power and which the expert can use for description of the situation representation without thereby changing the core of the invention. However, in selection of a planning system attention is to be given to the fact that this makes available planning algorithms of appropriate power for the modeling.

The reported passengers P1, P2 and the floors f1 to f7 of the building are initially made known to the planning system 5 in an object declaration 15 in the state description 14 illustrated in FIG. 3. A typified constant is imported for each object. For the elevator under consideration here, these are the waiting passenger P1, the passenger P2 already in the car and all seven floors f1 to f7.

The broker 6 obtains details with respect to the topology of the building from the configuration manager 11. This is to be found as a topology description 16 in the state representation 14 again in the form illustrated in FIG. 3.

In the topology description 16 the (upper ?fi, ?fj) prescriptions establish in each instance that the story fj lies above the story fi. The representation of the building topology is not absolutely necessary. In a simplification, the explicit topological description 16 of the building can be dispensed with in other embodiments of the method subject to the assumption that from each floor every other floor can be served by the elevator.

The actual transport request 17 with the destination calls of the passengers P1 and P2 consisting of boarding floor, i.e. "origin", and destination floor, i.e. "destin", is represented as shown in FIG. 3.

The transport request 17 additionally contains, from a travel sequence planned earlier, the information "boarded p2", namely that passenger P2 has already boarded and is in the car. This information was inserted into the state description by the observer 10.

Fundamentally, within the scope of the travel sequence planning each passenger P1, P2 occupies the three states: "waiting", "boarded" and "served", which are defined as follows:

waiting: the passenger waits in front of the elevator door. Here the elevator is initially to stop at the starting location, i.e. "origin", of the passenger and only thereafter at the destination floor, i.e. "destin", indicated by the passenger.

boarded: the passenger is located in the elevator car and is transported to his or her destination floor, i.e. "destin", which has not been traveled to previously, i.e. served.

served: the passenger has left the elevator car at his or her destination floor, i.e. "destin". This transport request is concluded and the passenger was satisfactorily served by the elevator.

These three possible states can be expressed by means of the two commands -boarded ?p- and -served ?p- in the PDDL modeling language. The passenger P1 waits for an elevator car and accordingly is registered neither as -boarded- nor as -served-.

The observer 10 sets the actual position 18 of the elevator car, which is expressed in the state representation 14 as (elevator-at f4)).

The objective 19 for the planning system 5 is formulated in the state description 14 as: (:goal (for all (?p- passenger) (served ?p)).

The shortest sequence of stops which transfers all passengers P1, P2 into the state of -served- is now sought, this being achieved precisely when the passengers have alighted at their destination floor -destin-.

Apart from the descriptions of the initial state and the objective state of the planning problem by the state description 14, there is transferred to the planning system 5 also an operator description 12. In the embodiment illustrated here, a stop operator as well as an operator for upward travel -up- and an operator for downward travel -down- are transferred for the modeling of the state transitions between initial state and objective state. As an alternative to these operators -stop-, -up- and -down-, the expert also knows other operators by which the desired change in the elevator state can be achieved. In a given case and with appropriate definition of the parameters, the core of the invention is not thereby changed. In PDDL syntax according to McDermott et al., 1998, the following stop operator is available:

```
(define (domain miconic)
(:requirements :adl)
(types passenger -object)
floor - object)
(:predicates
(origin ?person - passenger ?floor - floor)
(destination ?person - passenger ?floor - floor)
(boarded ?person - passenger)
(served ?person - passenger)
(elevator-at ?floor - floor))
(:action stop
: parameters (?f- floor)
: precondition (and (elevator-at ?f)
effect (and (forall (?p- passenger) (when (and (boarded ?p)
(destination ?p ?f))
(and (not (boarded ?p)) (served ?p))))
(forall (?p- passenger) (when (and (origin ?p ?f) (not (served
  ?p))) (boarded ?p)))))
```

The operator for the upward travel is represented as:

```
(:action up
: parameters (?f1 - floor ?f2 - floor)
: precondition (and (elevator-at ?f1) (upper ?f1 f2))
: effect (and (elevator-at ?f2) (not (elevator-at ?f1))))
```

The operator for the downward travel is expressed as:

```
(:action down
: parameters (?f1 - floor ?f2 - floor)
: precondition (and (elevator-at ?f1) (upper ?f1 f2))
: effect (and (elevator-at ?f2) (not (elevator-at ?f1))))
```

The stop operator signals to the control of the drive 9 of the elevator that the car has to stop at a specific floor f1 to f7. The stop operator is so defined in the example of embodiment illustrated here that it includes the opening and closing of the doors. The opening and closing of the car doors can, however, also be considered as a separate additional basic instruction to the door manager 7 of a elevator or the stop operator can be refined to the effect that a elevator can also open and close the doors.

The operators for upward travel -up- and downward travel -down- give the instructions in terms of control technology to the drive control to set the drive 9 into operation in the appropriate direction. The taxi driver 8 presets the sequence in time in which the drive 9 is controlled by means of the operators.

A change in the passenger state is possible basically exclusively at a stop of the car. Proceeding from rational behavior of the passengers, in the case of a scheduled stop of the elevator car at a floor all passengers who wait at this floor -origin- in order to be transported in the car get on board and all passengers leave the car when this stops at their destination floor -destin-. The thereby occurring change is here registered in the stop operator with the help of the observer 10 and thereby taken into consideration in the travel sequence planning of the planning system 5. Like the operators -up- and -down-, the stop operator is then also effective as an instruction for the drive 9 if the criteria coded in -effect- are all fulfilled or entered. If, in the example described here, ?f=f5 is selected in the stop operator, then P2 disembarks in correspondence with the state description 14 and the behavior model when -boarded p2- and -destin p2 f5- apply as described in the stop operator as -effect- of the operator instance stop(f5).

The data to that extent declared either in the operator description or as data of the state description 14 are passed on to the planning system 5 for computation of the optimal travel sequence plan.

Planning systems 5 are already known from other technical fields. In this example an IPP planning system 5, as appears from Koehler et al., 1997, "Extending planning graphs to an ADL subset", in Steel, S, Proceedings of the 4th European Conference on Planning, pp. 273–285, Springer, Vol. 1348 of LNAI, available under http://www.informatik.unifreiburg.de~koehler/ipp.html, searches for an applicable sequence of STOP instructions which fulfills the planning objective 19 (:goal(forall (?p-passenger) (served ?p)). Other planning systems can also be used insofar as these are in the position of generally detecting and processing the instantaneous situation representation.

In principle, the planning system 5 independently selects, in the case of input of the state description 14, instances on the basis of the operators made available by way of the operator description and also determines the sequence in the ascertained travel sequence plan 20. See FIG. 4. The planning system 5 determines each time the parameters for the three operators -stop-, -up- and -down-, produce a desired change in state.

The result thereof is, in this embodiment, a planned travel sequence, i.e. the optimal plan, which is represented in graphical form in FIG. 4.

Time step 0: up f4 f5

Time step 1: stop f5

Time step 2: down f5 f2

Time step 3: stop f2

Time step 4: up f2 f7

Time step 5: stop f7

This computed optimal plan 13 is passed on to the broker 6. The broker 6 thereupon checks the generated optimal plan, how the newly planned-in passenger P1 has an effect on the transport of the already booked passenger, and communicates the transport offer to the terminal.

In the embodiment described here only a destination call is present for the planning. Consequently, an offer is to be delivered only for one job. Accordingly, no other jobs are booked by other terminals 3.1, 3.2, 3.3 between the offer computation by the decentralized job manager 4 and the booking by the respective terminal. For this reason the acknowledgement of its booking at the terminal is redundant, but the booking is immediately obligatory. The terminal now undertakes the indication on the display and the broker transmits to the taxi driver 8 the actual optimal travel sequence plan 20.

The taxi driver 8 goes over this actual travel sequence plan 20, i.e. it transmits the corresponding command in the form of respective operators to the drive 9 of the elevator and to the drive of the doors.

This travel sequence plan 20 has the effect that the elevator car in step "0" travels from the actual floor f4 at which it is disposed to the next stop at floor f5, -stop f5-. There the elevator car stops according to step "1" -stop f5- and the car door opens at the predetermined time, so that the passenger P2 alights and is thus served, 'served'. In step "2", the elevator car travels downwards from f5 to f2 -down f5 f2- and stops in step "3" at floor f2 -stop f2-.

There passenger P1 boards. In step "4" the elevator travels upwards from floor f2 to f7 -up f2 f7- and stops in the last step "5" at story f7 -stop f7-. There also passenger P1, can now alight. Through this travel sequence 13 all passengers P1, P2 are transferred into the state -served- and the objective formulation 19 of the travel sequence plan is thus achieved.

While the taxi driver 8 executes the optimal travel sequence plan 20, the observer 10 monitors the state of the elevator installation and continuously updates the situation representation for the planner 5. In step "1" it thus establishes that the elevator has stopped at the floor f5 and the doors were opened correctly; it flags the passenger P2 as -served-. In step "2" the observer 10 flags the passenger P1, who waits at the floor f2, as -boarded-. Subsequently, the elevator car stops at the floor f7 and, after the doors have been correctly opened, the observer 10 also sets the passenger P1 in the situation description as "served" and the actual position 9 of the elevator car in the state representation 5 at floor f7.

This generated travel sequence plan 20 does not, however, necessarily have to be fully executed, but if the state or the characteristics of passengers and/or the installation change in relevant manner before it is completely executed, according to the invention a next planning cycle is started and an optimal travel sequence plan 20 for the new planning situation is created. No plan modification therefore takes place.

Figure 5:
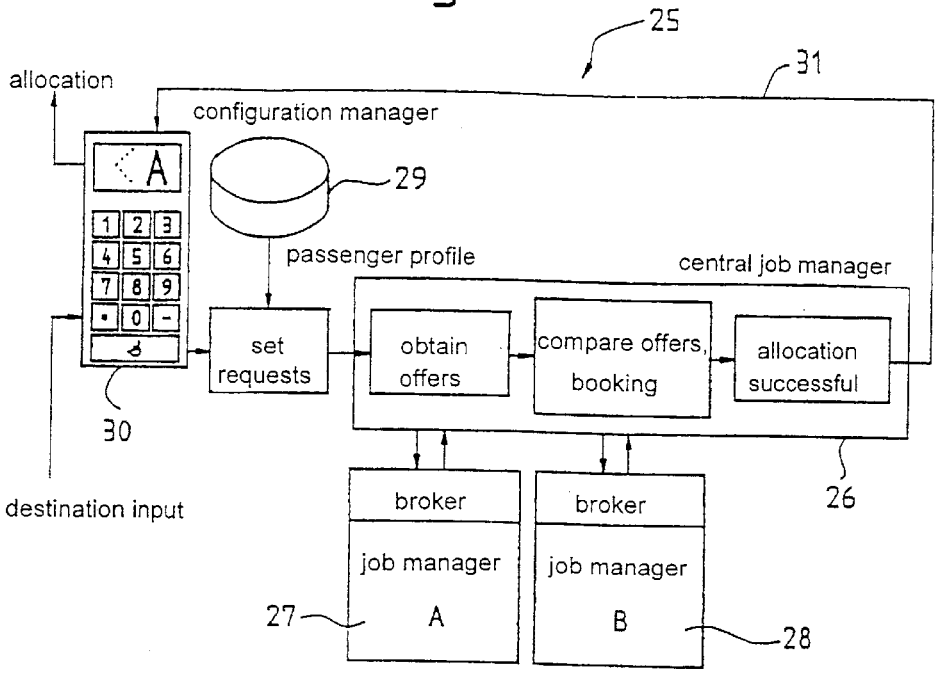
FIG. 5 is a block diagram of the construction of a second embodiment of the targeted call control, according to the present invention, with a central job manager as an interface between terminals and the individual elevators.

FIG. 5 shows schematically the structure and basic build-up of a second embodiment of the targeted call control according to the invention. The targeted or destination call control 25 comprises a central job manager 26 and two decentralized job managers 27, 28, a configuration manager 29 as well as a terminal 30 representative of all terminals present, these components being interconnected by way of a communications device 31. The build-up and function of the decentralized job managers 27, 28 substantially correspond with those of the decentralized job manager 4 of the first embodiment.

The destination call control 25 is here organized as a so-termed group control of the traffic of an elevator group with two elevators "A" and "B" in a building with stopping points at seven floors. The planning task in that case is represented as follows:

The elevator car "A" travels, at that moment, upwardly; it is disposed at that instant at floor f2 and can still reach the floor f3. The elevator car "B" stands at that instant at the floor f1. Elevator "A" transports a passenger P1 who has access restriction to floors f3 and f4 and who has indicated floor f7 as the destination, whereas elevator "B" is empty. In this situation a new passenger P2 appears who, as a VIP, has to be conveyed as a matter of priority before all other passengers. Passenger P2 has just delivered his or her request for transport from floor f3 to story f7.

An allocation of the passenger P2 to one of the two elevators "A", "B" known in the example is thus undertaken in the manner that the passengers P1, P2 are conveyed with the least possible stops and that the desired service requirements "VIP" and "access restriction" are fulfilled.

Figure 6:
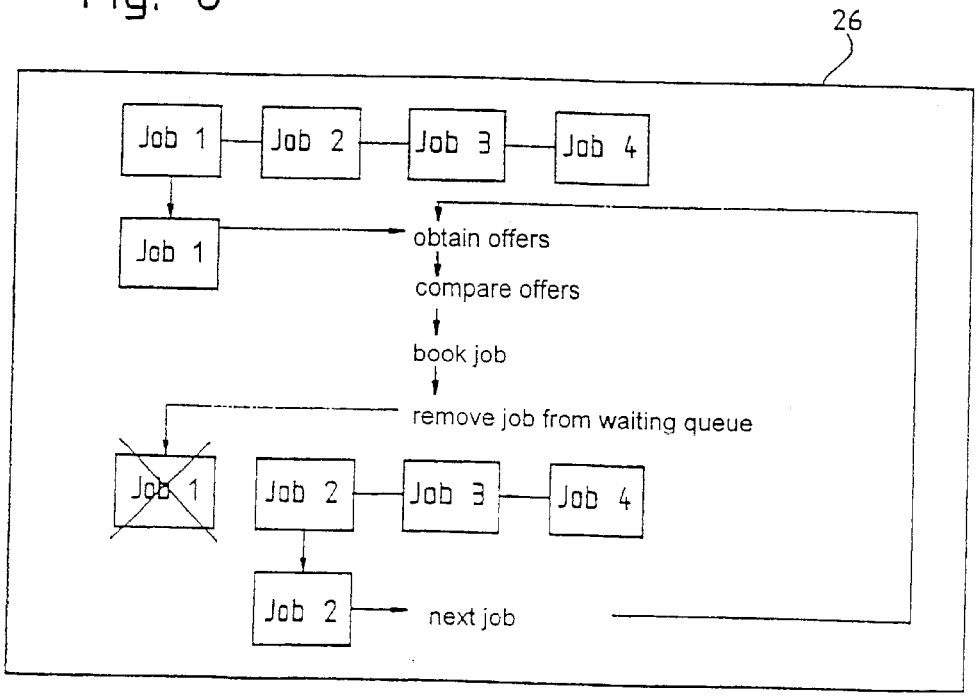
FIG. 6 shows a schematic illustration of the organization of the jobs in a waiting queue at the central job manager shown in FIG. 5.

The central job manager 26 collects the requests of the terminals 30 together with the respectively detected person-related data from the configuration manager 29 as so-termed jobs, here Job 1 to Job 4, in a waiting queue, as illustrated in FIG. 6. It selects the first Job 1 from the queue and transmits this to the decentralized job managers 27, 28 of the individual elevators. Each of the decentralized job managers 27, 28 of the elevators "A", "B" ascertains, independently of the others and with the help of its planning system, its best travel sequence solution on the basis of the predetermined optimization criterion and sends this as an offer back to the central job manager 26. The central job manager 26 checks all offers, selects from these the best offer and books the passenger on the elevator with the best offer. The identification of the best elevator is transmitted, after a successful allocation, to the terminal 30 at which the job was originally initiated. The terminal 30 thus merely functions as a display. The Job 1 is thus dealt with and is cancelled. The process is repeated only with the Job 2, etc., until all jobs of the waiting queue have been worked through.

Each decentralized job manager 27, 28 of the elevators "A", "B" initially creates, for the registered data information communicated as a job for the actual planning task, a situation representation which is transferred to the respective planning system included in the job manager. The situation representation contains a state description 32 (FIG. 7) and an operator description.

For the elevator "A", in an object description 33 the reported passengers P1, P2 and the floors f1 to f7 of the building are made known to the planning system. A typified constant is introduced for each object. Moreover, an association with one or more service requirements, such as, for example, "VIP", "conflict", '"going_direct", etc., is carried out in an object description 33 for each passenger P1, P2.

The service requirements are known in each case within the scope of the passenger recognition from the configuration manager 29 and passed on from the central job manager 26 as part of a job, or an offer enquiry, to the decentralized job managers 27, 28 of the individual elevators "A", "B". Specific service requirements for all or any selected passengers can be provided to be activatable in dependence on the state of the elevator installation or the building or even in dependence on the time of day. In addition, through the use of a planning system for the travel sequence determination there can be represented a flexible weighting of the individual service requirements, especially the VIP requirement, in dependence on traffic volume.

Here the following service requirements are provided:

Division of all passengers into two groups "'conflict_A" and "conflict_B", who may never go into the elevator;

Passengers of the type "never_alone", for whom a companion in the form of a passenger of the type "attendant" must be present in the elevator during the travel. In that case it is not absolutely necessary that always the same companion travels in the elevator during the travel, but this can also change;

Passengers of the type "going_direct", who are conveyed to their destination without an intermediate stop;

Passengers of the type "vip", who are conveyed as a matter of priority before all other passengers;

Passengers for whom an access restriction to specific stories is formulated;

Passengers of the type "going_up", who are transported exclusively upwards;

Passengers of the type 'going_down', which are transported exclusively downwards.

A passenger P1, P2 can thus quite readily be the subject of a number of service requirements; however, these should not conflict, so that the passenger can also be efficiently conveyed. Two passengers P1, P2, for example, are an elemental conflict, for which the following typification is declared:

(P1 (either conflict_A never_alone))

(P2 (either conflict_B attendant))

P1 here may not travel solely in the elevator and belongs at the same time to the passenger group "A". The single possible companion P2 known to the system belongs, however, to the passenger group "B". The passenger group "A" may never go into the elevator with the passenger group "B" and thus the attendant infringes the exclusion condition and P1 can only be conveyed when another companion, who does not belong to the group "B", becomes known to the system.

For elevator "A" the object description 33 shown in FIG. 7 contains the already travelling passenger P1, i.e. a normal passenger, the new passenger P2, i.e. a VIP, and all seven floors f1 to f7.

In this embodiment an express description of the building topology is dispensed with on the assumption that from each floor each other floor can be served.

The actually registered transport request 34 of the passengers P1 and P2 is represented in FIG. 7.

Fundamental to the transport request 34 is the standard assumption that passengers wait at the floor when no corresponding "boarded" information is present. Precisely, this signifies here that passenger P2 waits at the floor. The access restriction for passenger P1 is represented therein as:

(no-access P1 f3)

(no-access P1 f4).

The actual position 35 of the elevator car of the elevator "A" is expressed in FIG. 7 as (elevator-at f2)) in the state description 32. All expressed facts are weighted as true and all others as false.

The objective 36 for the planning system is formulated as (:goal (forall (?p- passenger) (served ?p)).

The shortest sequence of stops which transfers all passengers P1, P2 into the state of "served" is sought, which is achieved precisely when they have disembarked at their destination floor or floor f7.

Since in this embodiment only a minimal stop sequence is to be determined, the planning system also receives only one so-termed stop operator 37, from which the system can construct a valid travel sequence plan. In FIG. 9 there is illustrated an example of the stop operator 37. The modeling language PDDL according to McDermott et al., 1998, here too serves for pictorialization as before in the state description 32. The stop operator 37 contains a prescriptive description 38 in which it is described when a stop of an elevator "A", "B" at a floor f1 to f7 is permissible. Here the access restriction -no-access- which in that case is defined concretely either for a passenger or, however, for a passenger group, and a function instruction 39 in which it is established at which floor f1 to f7 an elevator car shall stop at a permissible stop and what effect this stop has on the actual state of the elevator installation 18. Preconditions of the function instruction 39 in that case represent the user specific conversion of the desired service requirements. The complex stop operator shown in FIG. 9 makes it possible to bypass the planning system by all service requirements imported into the passenger and object declaration 33.

For the planning example described here, only the preconditions, which are outlined in FIG. 7, of the operator or state description 32 are relevant, which preconditions formulate the conditions at a stop at a floor f1 to f7 in the presence of VIPs and passengers with access restriction.

The instantaneous state description 32 created to that extent for each elevator "A" is passed on to the planning system belonging to the elevator "A".

The suitable planning systems used in accordance with the invention operate independently of the actual planning problem. Such planning systems are already known from other technical fields.

In this second embodiment, too, an IPP planning system, as known from Koehler et al., 1997, Extending planning graphs to an ADL subset, appearing in Steel, Proceedings of the 4th European Conference on Planning, pp. 273–285, Springer, Vol. 1348 of LNAI, and available under http://www.informatik.unifreiburg.de/~koehler/ipp.html, seeks a valid sequence of STOP instructions which fulfill the planning objective 36. Other planning systems can also be used insofar as these are in a position of detecting and processing the instantaneous situation representation in its entirety.

In solving a concrete planning task, the planning system selects the operators, which are to be used in the travel sequence plan, of the operator description, here the stop operator 37. If service requirements, such as, for example, "VIP", "going_direct", etc., occur in the state description 32, then the planning system independently checks the corresponding preconditions of the function instruction 39 of the operator 37. If a service requirement contained in the operator 37 as a precondition is absent in the call-relevant state description 32, then this is automatically disregarded as a superfluous precondition of the operator 37. An example of a service requirement not taken into consideration here is the precondition -attendant-. Concrete values for operator parameters as well as an arrangement sequence in which operators occur in the travel sequence plan are then determined. This arrangement sequence specifies the execution sequence of the operators in the travel sequence and thus the travel sequence for serving the respective destination call.

The planning system cannot find a solution for elevator "A": passenger P2 shall be immediately conveyed, i.e. the elevator "A" has to stop at f3. However, P1 is in the elevator and has no access to f3. A stop at f3 is thus possible only after P1 has disembarked, i.e. the elevator "A" must first travel to floor f7; this in turn is not allowed, since the VIP condition requires VIPs to be conveyed ahead of all other passengers.

The situation or state description 42 can be solved by the planning system for the elevator "B" (FIG. 8) without problems, since elevator "B" does not know the passenger P1 at all, because he or she is in fact underway in the elevator "A" and only the new passenger P2 is reported. The object description 43 for elevator "B" at the planning system consequently contains also only the new passenger P2, who is typified by the service requirement VIP, and all seven floors f1 to f7.

Moreover, from each floor each other floor can be served. The actual transport request 44 of the passenger P2 is shown in FIG. 8. The actual position description 45 of the elevator car "B" is expressed in the state description 42 as (elevator-at f2).

In the case of the elevator "B", the objective formulation 46 for the planning system is identical with that of the elevator "A". It is transferred to the planning system together with the object declaration 43 and the above-described stop operator 37 as part of the situation representation 42 of the elevator "B". For planning of the travel sequence of the elevator "B", only the operator precondition "stop at a floor in the presence of VIP" is relevant, because the state description 32 for elevator "B" also transfers to the planning system only the service requirement VIP. All remaining service requirements provided in the form of prescriptions or object description 33 and preconditions of the function instruction 39 of the STOP operator 37 remain unconsidered in this planning sequence and accordingly without effect on the travel sequence plan.

The planning system generates, starting from this input, the following travel sequence plan for elevator "B":

time step 1: (stop 3)

time step 2: (stop 7), which represents a minimum stop sequence for successful conveying of the passenger P2.

If the results of the travel sequence plan of the elevators "A", "B" are entered at the central job manager 26, this then weights the two travel sequence offers of the elevators "A", "B". The elevator with the best offer is selected by the central job manager 26. The best solution is here the single possible travel sequence plan of the elevator "B". Consequently the central job manager books the passenger P2 on the elevator "B". Elevator "B" also actualizes the travel sequence plan after receipt of the booking; all other elevators carry on travelling in accordance with their previous plan.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for travel sequence planning in a elevator installation, in which a travel sequence optimal with respect to a predetermined optimization criterion is determined for each travel request input at terminals located at floors served by the elevator installation, comprising the steps of:

a. detecting a destination floor specific travel request input at a terminal located at one of a plurality of floors served by at least one elevator;

b. performing a situation-based search process for determining the optimal travel sequence plan for the travel request; and c. determining an actual travel sequence plan for the travel request in response to a relevant change in the situation upon which the optimal travel sequence plan is based.

2. The method according to claim 1 wherein said step c. is performed by combining detected actual data specific to persons and the elevator installation and relevant to planning into a state description that is understandable by the search process, and supplying an actual operational state of the elevator installation, an objective state of the elevator installation to be produced and at least one operator specifying an elemental state transition of the elevator installation in the state description.

3. The method according to claim 1 wherein said step c. is performed by combining detected actual data specific to persons and the elevator installation and relevant to planning into a state description that is understandable by the search process.

4. The method according to claim 1 wherein said step c. is performed by supplying an actual operational state of the elevator installation, an objective state of the elevator installation to be produced and at least one operator specifying an elemental state transition of the elevator installation in a state description that is understandable by the search process.

5. The method according to claim 4 including constructing the at least one operator in modular for containing instructions which relate to control technology associated with travel request service requirements.

6. The method according to claim 5 including performing said steps b. and c. for at least another elevator of an elevator group including the at least one elevator, the elevator group being able to simultaneously serve multiple travel requests.

7. A method for travel sequence planning in a elevator installation wherein destination specific travel requests are input at terminals located at floors served by the elevator installation, comprising the steps of:

a. detecting a destination floor specific travel request input at a terminal located at one of a plurality of floors served by at least two elevators of an elevator installation;

b. generating a request from the terminal to a job manager associated with each of the elevators for an offer to serve the travel request;

c. causing the job manager to perform a situation-based search process for determining for each of the elevators an optimal travel sequence plan for serving the travel request;

d. submitting at least one offer to serve the travel request based upon the optimal travel sequence plan of one of the elevators; and e. prior to booking the travel request, determining an actual travel sequence plan for the travel request in response to a relevant change in the situation upon which the optimal travel sequence plan of the at least one offer is based.

8. The method according to claim 7 wherein said step b. is performed by including in the request detected actual data specific to persons and the elevator installation and relevant to the search process.

9. The method according to claim 7 wherein said step c. is performed by supplying an actual operational state of the elevator installation, an objective state of the elevator installation to be produced and at least one operator specifying an elemental state transition of the elevator installation in a state description that is understandable by the search process.

10. The method according to claim 7 including sending a booking from the terminal to the job manager in response to the at least one offer and sending an acknowledgement from the job manager to the terminal in response to the booking.

11. A targeted call control for determination of a travel sequence of at least one elevator car of an elevator installation, comprising:

at least one call registration terminal for detecting destination floor specific travel requests;

a job manager for determining a travel sequence which is optimal with respect to a given optimization criterion for a travel request detected at said terminal, said job manager including a planning system for determining said travel sequence as a situation-specific optimal travel sequence; and a communication means connecting said terminal and said job manager.

12. The targeted call control according to claim 11 wherein said planning system is part of a multi-agent system and said communication means is a communications network connecting said terminal to said planning system.

13. The targeted call control according to claim 11 wherein said job manager is adopted to determine a travel sequence which is optimal with respect to a given optimization criterion for the travel request with respect to each of at least one elevator with one deck and at least one elevator with two decks.

14. The targeted call control according to claim 11 wherein said job manager is a decentralized job manager associated with an elevator car, said job manager including a drive associated with the elevator car, a taxi driver connected to said drive for operating said drive to implement the optimal travel sequence, and a broker connected between said planning system and said taxi driver for transferring the optimal travel sequence.

15. The targeted call control according to claim 14 wherein said job manager includes a door manager connected to said taxi driver for operating a door of the elevator car to implement the optimal travel sequence, and an observer connected to said drive, said door manager and said planning system for reporting a status of each of said drive and said door manager.

* * * * *